US012447396B2

(12) United States Patent
Dowling et al.

(10) Patent No.: US 12,447,396 B2
(45) **Date of Patent: *Oct. 21, 2025**

(54) GAME TABLE

(71) Applicant: SKEECH Games, LLC, Fort Collins, CO (US)

(72) Inventors: Joshua Dowling, Fort Collins, CO (US); Zachary Dowling, Timnath, CO (US)

(73) Assignee: SKEECH Games, LLC, Fort Collins, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/109,148

(22) Filed: Feb. 13, 2023

(65) Prior Publication Data

US 2023/0226437 A1 Jul. 20, 2023

Related U.S. Application Data

(63) Continuation of application No. 16/849,253, filed on Apr. 15, 2020, now Pat. No. 11,638,866.

(Continued)

(51) Int. Cl.

| | |
|---|---|
| ***A63F 7/00*** | (2006.01) |
| ***A63F 7/30*** | (2006.01) |
| ***A63F 7/34*** | (2006.01) |

(52) U.S. Cl.

CPC ..... *A63F 7/0017* (2013.01); *A63F 7/30* (2013.01); *A63F 7/34* (2013.01); *A63F 2007/346* (2013.01)

(58) Field of Classification Search

CPC .. A63F 7/0017; A63F 7/34; A63F 7/30; A63F 2007/346; A63F 7/0005;

(Continued)

(56) References Cited

U.S. PATENT DOCUMENTS

| | | | |
|---|---|---|---|
| 202,071 | A | 4/1878 | Strange |
| 607,020 | A | 7/1898 | Dodge |

(Continued)

FOREIGN PATENT DOCUMENTS

| | | | |
|---|---|---|---|
| EP | 0364882 | B1 | 4/1994 |
| JP | 2014180527 | A | 9/2014 |

OTHER PUBLICATIONS

Skee Roll, retrieved from Internet at <http://www.allisonsfuninc.com/inventory/m.directory/78/view/646> on Apr. 15, 2020, 1 page.

(Continued)

*Primary Examiner* — Sebastiano Passaniti

(74) *Attorney, Agent, or Firm* — Cochran Freund & Young LLC; William W. Cochran

(57) ABSTRACT

A game table is provided with a generally flat playing surface having opposed playing ends position spaced apart in a length dimension to allow players to participate from each of the playing ends. The playing surface has a length dimension greater than a width dimension of the playing surface. A plurality of holes is formed with a V-shaped pattern oriented in the length dimension. The V-shaped pattern is positioned adjacent each of the playing ends. The V-shaped pattern has a plurality of holes that increase in diameter away from the end hole. A gutter surrounds the playing surface.

14 Claims, 5 Drawing Sheets

Related U.S. Application Data

(60) Provisional application No. 62/920,087, filed on Apr. 15, 2019.

(58) Field of Classification Search
CPC ..... A63B 67/02; A63D 15/003; A63D 15/02; A63D 15/00
USPC ..... 273/123 R, 127 C, 127 B, 118 R, 142 R, 273/125; 473/115–117, 17–20, 28; D21/303, 341, 342, 345, 346, 321
See application file for complete search history.

(56) References Cited

U.S. PATENT DOCUMENTS

| | | | | |
|---|---|---|---|---|
| D34,806 | S | 7/1901 | Wilbraham | |
| 952,644 | A | 3/1910 | Sato | |
| 1,086,959 | A | 2/1914 | Vinton | |
| 1,154,529 | A | 9/1915 | Meluzzi | |
| 1,234,618 | A | 7/1917 | Brenner | |
| 1,259,888 | A | 3/1918 | MacCormack | |
| 1,295,236 | A | 2/1919 | Thomas | |
| 1,314,843 | A | 9/1919 | West | |
| 1,385,677 | A | 7/1921 | Gillette | |
| 1,409,527 | A | 3/1922 | Debelack | |
| 1,589,904 | A | 6/1926 | Schilke | |
| 1,714,905 | A | 5/1929 | Dieterich | |
| 2,005,660 | A | 6/1935 | Maxwell | |
| 2,247,769 | A | 7/1941 | Constant | |
| D142,122 | S | 8/1945 | Rolley | |
| 2,409,373 | A | 10/1946 | Mautner et al. | |
| 2,529,535 | A | 11/1950 | Bertelsmeyer | |
| 2,719,717 | A | 10/1955 | Verity | |
| 2,724,594 | A | 11/1955 | Anderson | |
| 2,850,283 | A | 9/1958 | Lemelson | |
| 3,386,737 | A | 6/1968 | Burgess | |
| 3,450,406 | A | 6/1969 | Brown | |
| 3,640,535 | A * | 2/1972 | Gendler | A63F 9/02 273/336 |
| 3,764,139 | A | 10/1973 | Cohen | |
| 3,992,009 | A | 11/1976 | Trbovich | |
| 4,146,228 | A | 3/1979 | Laciste | |
| 4,261,577 | A | 4/1981 | Ellis | |
| 4,316,613 | A | 2/1982 | Harris | |
| 4,348,026 | A | 9/1982 | Kauffmann | |
| 4,995,611 | A | 2/1991 | Goldthorpe | |
| 5,209,493 | A | 5/1993 | Chernek | |
| 5,865,681 | A * | 2/1999 | Tudek | A63F 7/0017 473/15 |
| 7,325,807 | B1 | 2/2008 | Eason | |
| 8,205,887 | B2 | 6/2012 | Wyland | |
| 8,439,359 | B2 | 5/2013 | Stites | |
| 9,044,665 | B2 | 6/2015 | Haase et al. | |
| 9,782,666 | B2 | 10/2017 | Dahl et al. | |
| 10,307,664 | B1 | 6/2019 | Villela | |
| D985,060 | S * | 5/2023 | Dowling | D21/385 |
| 11,638,866 | B2 * | 5/2023 | Dowling | A63F 7/34 273/125 R |
| 2005/0006841 | A1 | 1/2005 | Schromm | |
| 2005/0104284 | A1 | 5/2005 | Pollu | |
| 2006/0226606 | A1 | 10/2006 | Finley et al. | |
| 2008/0143047 | A1 * | 6/2008 | Lokos | A63F 7/0017 273/121 R |
| 2009/0033031 | A1 | 2/2009 | Lany et al. | |
| 2009/0085298 | A1 | 4/2009 | Terich | |
| 2011/0256945 | A1 | 10/2011 | Hsiang | |
| 2012/0038109 | A1 | 2/2012 | Battista | |
| 2015/0165308 | A1 | 6/2015 | Huang | |
| 2018/0207503 | A1 | 7/2018 | Rivard | |
| 2019/0143200 | A1 | 5/2019 | Villela | |
| 2019/0184254 | A1 | 6/2019 | Hamilton et al. | |

OTHER PUBLICATIONS

Bank Shot, retrieved from Internet at <https://www.pinterest.com/pin/280982464228140204> on Apr. 15, 2020, 1 page.

Rollaball, retrieved from Internet at <https://data.dlf.org.uk/product.php?product_id=0030795&groupid=1678> on Apr. 15, 2020, 1 page.

* cited by examiner

GAME TABLE

CROSS-REFERENCE TO RELATED APPLICATIONS

The present U.S. Utility Application claims priority pursuant to 35 U.S.C. § 120 as a continuation of U.S. Utility application Ser. No. 16/849,253, entitled, "GAME TABLE," filed Apr. 15, 2020, which claims priority pursuant to 35 U.S.C. § 119(e) to U.S. Provisional Application No. 62/920,087, filed Apr. 15, 2019, both of which are hereby incorporated herein by reference in their entireties and made part of the present U.S. Utility Application for all that they disclose and teach.

BACKGROUND

Technical Field

The present application relates to a game using balls rolled on a game table.

SUMMARY

According to one embodiment, a game table is provided with a generally flat playing surface having opposed playing ends position spaced apart in a length dimension to allow players to participate from each of the playing ends. The playing surface has a length dimension greater than a width dimension of the playing surface. A plurality of holes is formed with a V-shaped pattern oriented in the length dimension. The V-shaped pattern is positioned adjacent each of the playing ends. The V-shaped pattern has a plurality of holes that increase in diameter away from the end hole. A gutter surrounds the playing surface.

DETAILED DESCRIPTION OF THE EMBODIMENTS

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
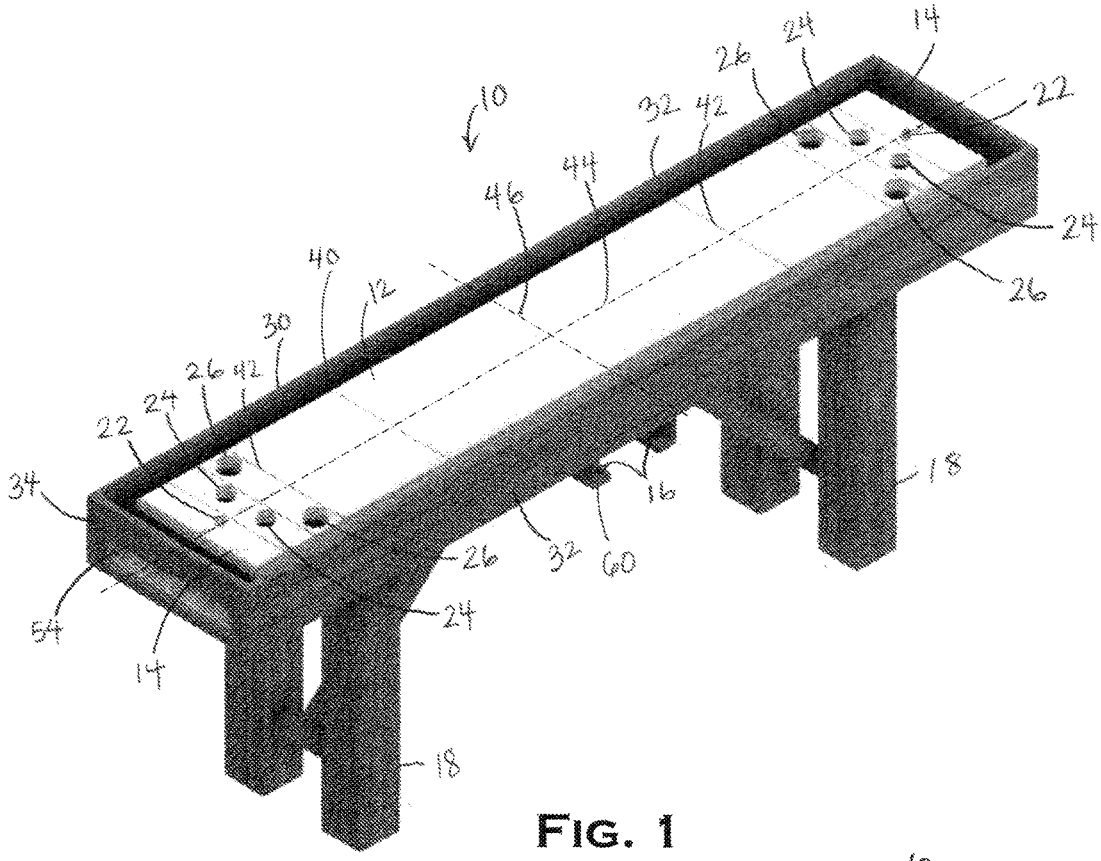
FIG. 1 is a front-side perspective view of a game table according to one embodiment.
Figure 2:
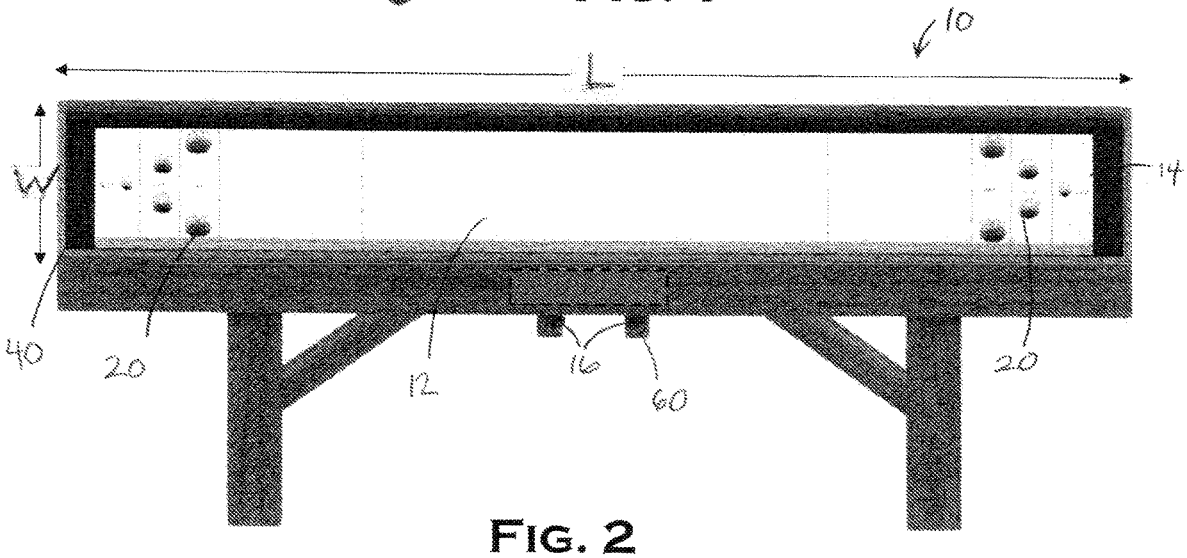
FIG. 2 is a front perspective view of the game table FIG. 1.

FIG. 1 illustrates a game table 10 with a flat playing surface 12 having two playing ends 14. Each player/team rolls balls 16 from each playing end 14 of the table to score points. Points are scored by making a ball 16 in a hole in the hole pattern 20. Each hole in the hole pattern 20 has a different point value. The large outer holes 26 are assigned one point, the intermediate holes 24 are assigned three points and the small-end hole 26 is assigned five points. The game is played to twenty-one points. The holes may be assigned other point values and different games and scoring values may be used.

The game starts with each player/team rolling balls, one at a time from one playing end 14 toward the hole pattern 20 at the opposite playing end. The game table 10 may include eight balls, four for each player/team, however any suitable number of balls is possible. Players/teams alternate rolling their balls after each player's turn. In one variation of the game, the object of the game is to score exactly twenty-one points by a combination of the holes 22, 24, 26. If a player's/team's score goes over twenty-one points at any time during their turn, that player's/team's score then goes back to fifteen points and they finish out their turn. When a player/team rolls exactly twenty-one points the game is not over yet and at this time, any remaining balls are rolled back to the opposing player/team. The opposing player/team always gets a chance to tie the game at twenty-one points with one final turn using all four balls. If the opposing player/team is not able to tie twenty-one points on this final turn, the game is over and the first player/team that scored twenty-one points wins. If the opposing player/team is able to tie twenty-one points on this final turn, then the game goes to sudden death. Sudden death is played by each player/team getting one final turn with all four balls and the high score wins the game.

The game table 10 of the present application allows players/teams to participate from each playing end 14. A two person game (one-on-one) or a four person game (two-on-two, or team play), where players/teams stand at opposite playing ends 14 of the game table 10 to play the chosen game. Unlike many one-ended games, such as bowling, skeeball, or arcade game, the game table 10 allows play from each of the playing ends 14. The game table 10 is a head-to-head game played by alternating the roll of balls 16 per player, per turn. When playing one-on-one, only four balls are required, and when playing teams, eight balls may be used. Some examples of play using the game table 10 include: 'One ball', 'Two ball,' or 'Four ball.' One ball is played by each player rolling four balls one at a time per turn (total of four rolls). Two ball is played by each player rolling two balls at a time per turn (total of two rolls). Four ball is played by each player rolling all four balls at one time per turn (total of one roll). Other games or numbers of balls may be used with the game table 10.

In one embodiment, the game table 10 and playing surface 12 are formed of wood. Wood offers a different grain and allows for variation in how the balls 16 roll on each individual game table. This gives every single table is own uniqueness and makes playing more fun because the players have to learn how each table rolls. Wood also looks aesthetically pleasing. The game table 10 may be built of wood and the necessary hardware or adhesives to assembly the table such as steel/metal screws wood glue, and other suitable fasteners. Other materials may be used to construct the game table, including but not limited to plastic, metal, aluminum, vinyl, or rubber. As shown, the game table 10 is supported by four legs 18 and cross-supports. However, the game table 10 may also be placed on any support surface such as a table.

As shown in FIGS. 1-6, the game table 10 is designed using a shadow box 30 making up the outside walls of the game table 10. The shadow box 30 has side walls 32 extending in a length direction L and end walls 34 adjacent the playing ends 14 and extending in a width direction W. The playing surface 12 is offset within the shadow box walls 32, 34. In the illustrated embodiment, the shadow box 30 has length of approximately 94-98 inches and a width of 10-20 inches. The shadow box walls 32, 34 have a height of 7-8 inches. In other embodiments, the shadow box has a length of 6-12 feet. The shadow box 30 may also have a length of 1-5 feet. However, other sizes and dimensions of the shadow box 30 are contemplated.

Figure 3:
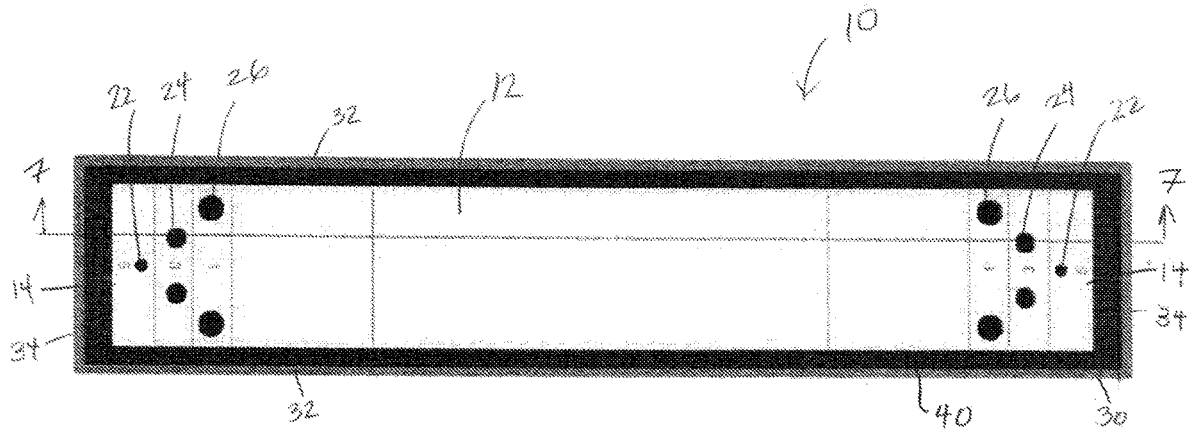
FIG. 3 is a top view of the game table of FIG. 1.
Figure 4:
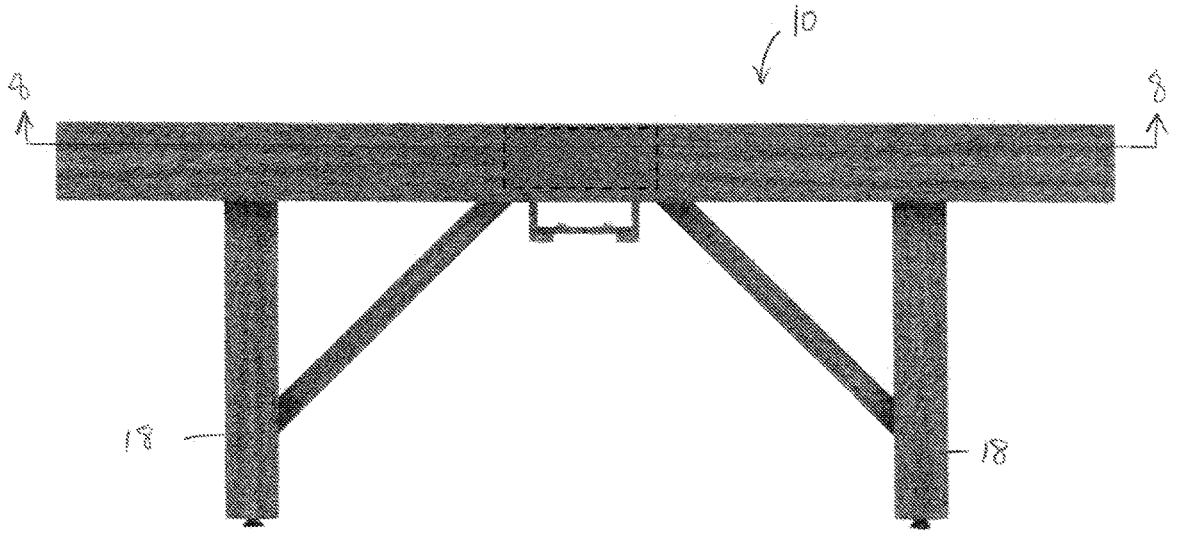
FIG. 4 is a front view of the game table of FIG. 1, where the back view is identical to the front view.
Figure 5:
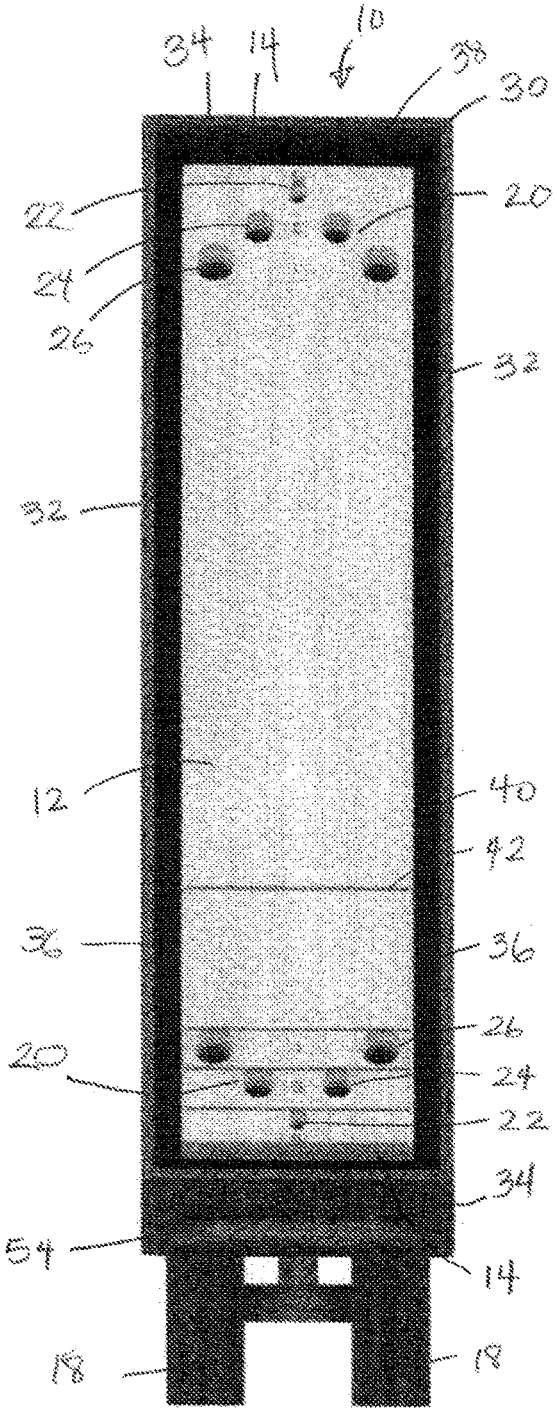
FIG. 5 is a right-side perspective view of the game table of FIG. 1.
Figure 6:
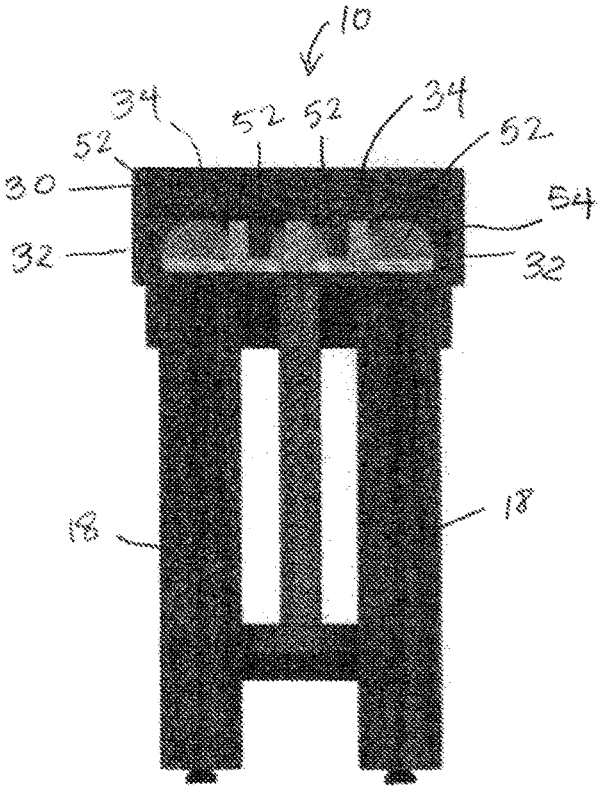
FIG. 6 is a right-side view of the game table of FIG. 1, where the left-side view is identical to the right-side view.
Figure 7:
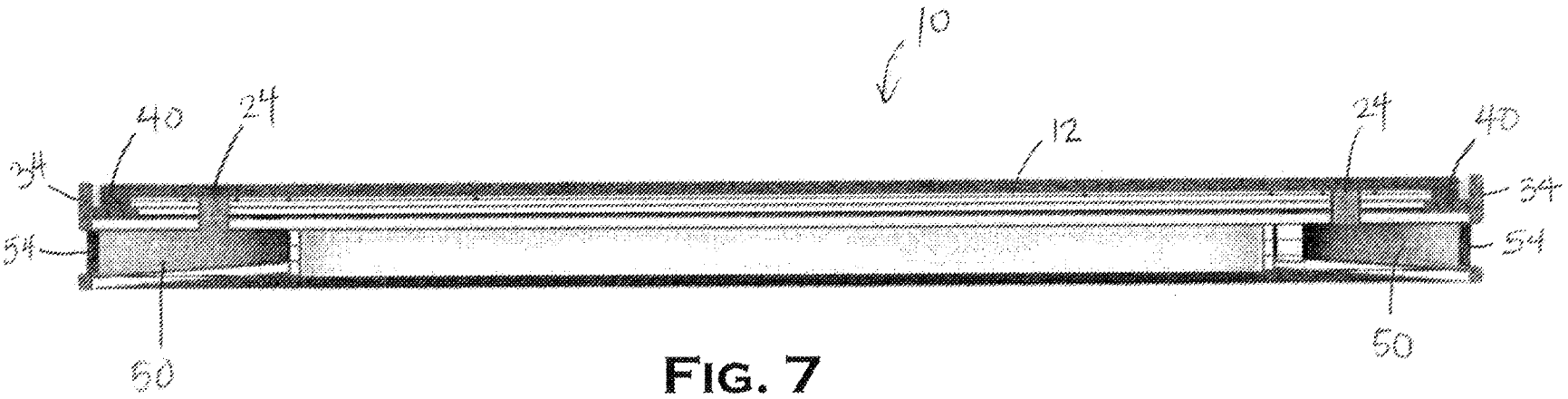
FIG. 7 is a front section view through line 7-7 of FIG. 3.
Figure 8:
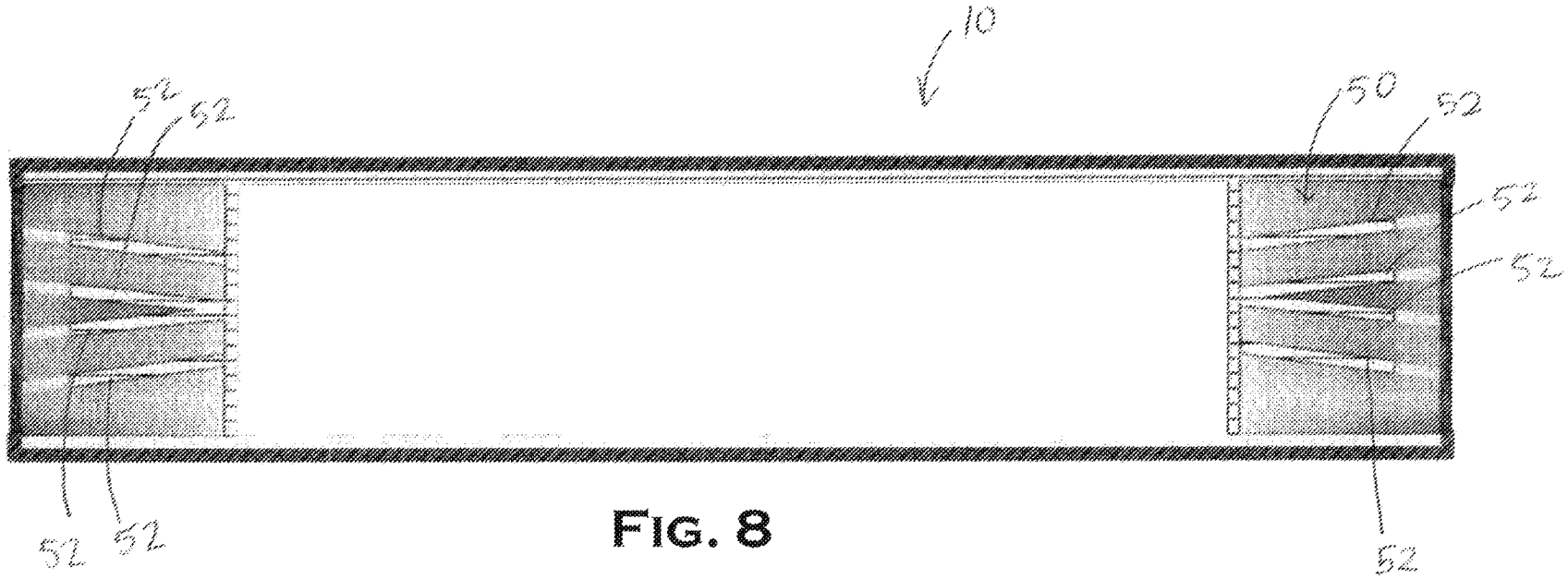
FIG. 8 is a top section view through line 8-8 of FIG. 4.

The playing surface 12 for the game table 10 is horizontal and planar as illustrated in FIGS. 3, 4 and 7. The playing surface 12 may be formed of a sheet of wood. In the illustrated embodiment, the playing surface 12 has a length of approximately 87-91 inches and a width of 15 inches. In other embodiments, the playing surface 12 may range in size from 1-12 feet in length. In another embodiment, the length of the playing surface 12 is at least five times the width. In further embodiments the length dimension of the playing surface is in the range of 2.5 to six times the width dimension. However, other sizes and dimensions of the playing surface 12 are contemplated. Further, the playing surface 12 may have different shapes. For example, the playing surface 12 may be oval, circular, rectangular, or square. The playing surface 12 may have an aspect ratio where the length is greater than the width, but the region along the playing end 14 may be semi-circular, parabolic or triangular for example.

The game table 10 has pair of hole patterns 20 defined adjacent each playing end 14. As shown in the Figures, each hole pattern 20 is V-shaped. The V-shaped hole pattern 20 is oriented in the length dimension to be symmetric about a longitudinal centerline 44 of the playing surface 12. The hole patterns 20 are spaced apart in the length dimension and are mirror images of each other about a midline 46 between the two opposing ends 11.

Figure 9:
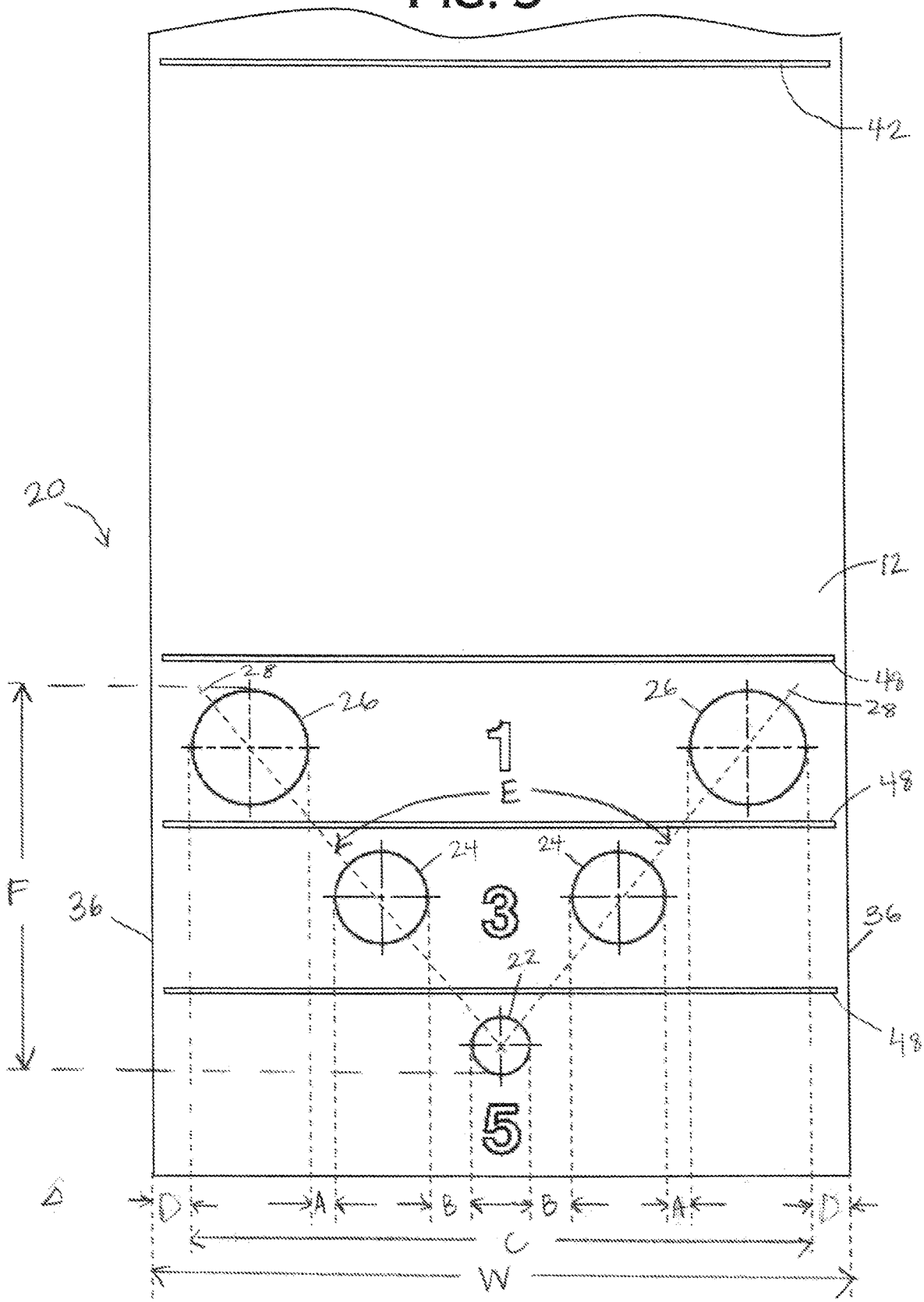
FIG. 9 is a detailed view of the playing end and the hole pattern.

FIG. 9 illustrates the playing surface 12 and one playing end 14 in more detail. Each hole pattern 20 is formed of two rows 28 of holes intersecting at the end hole 22. The holes 22, 24, 26 decrease in size towards the point of the V-shaped pattern. As the holes decrease in size the point value increases. In the illustrated embodiment, the two outer holes 26 have a diameter of approximately 2.5 inches and are worth one point. The outer holes 26 are the largest holes and closes to the midline 46. The outer holes 26 may have a diameter larger than the ball 16 provides the most clearance to the ball 16. The two inteiiiiediate holes 24 measure approximately 2 inches in diameter and are worth 3-points holes. The intermediate holes 24 are larger than the balls 16 and smaller than the outer holes 26. The small-end hole 22 is worth 5-points and measures 1.25 inches in diameter and positioned closest to each playing end 14 of the game table 10. The center end hole 22 is the smallest hole and is centered on the playing surface 12 in the width direction W. The dimensions of the holes 22, 24, 26 may change based on the overall dimensions of the playing surface 12 or the size of the ball 16.

The game table 10 includes balls 16 that may be steel ball bearings. In the illustrated embodiment, the steel ball bearings may be standard size such as 1.0625 inch diameter. The size of the ball 16 may vary based on the size of the holes 22, 24, 26. In another embodiment, the balls 16 may be steel ball bearings with a diameter of 16 millimeters to 0.75 inches. The balls 16 used with the game table 10 can be any suitable material wood, plastic, rubber, or steel. In the illustrated embodiment, the smallest center hole 22 has a diameter approximately 19% greater than the diameter of the ball 16. In another embodiment, the smallest center hole 22 has a diameter approximately 15-30% greater than the diameter of the ball 16. greater than the diameter of the ball 16. In the illustrated embodiment, the intermediate hole 24 has a diameter approximately 94% greater than the diameter of the ball 16. In another embodiment, the intermediate hole 24 has a diameter approximately 80-120% than the diameter of the ball. In the illustrated embodiment, the largest outer hole 26 has a diameter approximately 144% greater than the diameter of the ball 16. In another embodiment, the largest outer hole 26 has a diameter approximately 125-175% greater than the diameter of the ball 16. In a further embodiment, the smallest center hole 22 has a diameter up to 150% greater than the diameter of the ball, the intermediate hole 24 has a diameter up to 300% greater than the diameter of the ball 16, and the outer hole 26 has a diameter up to 500% greater than the diameter of the ball 16.

The holes in the hole pattern 20 are sized and positioned to allow a fun, yet challenging game between two players or teams of players. The holes 22, 24, 26 are spaced apart so that every roll does not result in the ball 16 going in one of the holes, but it is not impossible or too difficult to roll the balls 16 in the holes. The players must learn skill and accuracy to roll the balls in one of the holes 22, 24, 26. For example, each of the holes 22, 24, 26 are spaced apart in the width direction W by a hole-spacing distance that is less than a diameter size of the ball 16. For example, the outer holes 26 are spaced apart from the intermediate holes 24 by a first hole-spacing distance A. Similarly, the intermediate holes 24 are spaced apart from the center-end hole 22 by a second hole-spacing distance B. The second hole-spacing distance B is greater than the first hole-spacing distance A, which makes it more challenging to roll the ball in the center-end hole 22. In the illustrated example, the first hole spacing distance A is approximately 0.625 inches and the second hole spacing distance B is approximately 0.875 inches. Depending on the speed and how a player releases the ball 16, the ball 163 may roll just between each of the holes 22, 24, 26. This spacing gives the game just enough of a challenge to make it competitive but still have the games play fast. If the spacing was any wider between the holes, it would be more challenging to score, slowing down the pace of play.

The hole pattern 20 may have a pattern width C that is less than the width W of the playing surface 12. In the illustrated example, the pattern width C is approximately 13.25 inches where the width W is 15 inches. In one embodiment, the hole pattern 20 may have a pattern width C that is at least 75% of the width W. As such, the outer hole 26 may be offset from a longitudinal edge 36 of the playing surface 12 by an outer-dimension D. In the illustrated example, the outer dimension D is approximately 0.75 inches.

Each hole pattern 20 is formed of two rows 28 of holes having an outer hole 26, an intermediate hole 24 and small end hole 22. As illustrated, the two rows 28 intersect at the end hole 22 and therefore share the end hole. The rows of holes 28 are oriented at an angle E to form the V-shaped pattern 20. As illustrated, the angle E is 38 to 40 degrees. The angle E may be any angle that allows hole-spacing in the width direction so that the holes 22, 24, 26 do not overlap in the width direction. The V-shaped hole pattern 20 may have a pattern length F. In the illustrated example, the whole pattern length F is approximately 8.5 inches. The pattern length F may be less than the pattern width C. In one embodiment, the hole patterns 20 are spaced apart in the length direction by 4-7 times the pattern length F. In the illustrated example, the hole patterns are spaced apart by in a length direction by approximately 66-70 inches.

The holes in the hole pattern 20 are shown as circular holes but can be many different shapes including squares, rectangles, triangles, hexagons, or octagons, for example.

A gutter 40 surrounds the playing surface 12. The gutter 40 catches any balls 16 that roll off the playing surface 12 during a player's roll. As shown in FIGS. 1-6, the gutter 40 is defined between the walls of the shadow box 30 and the playing surface 12. In another embodiment, the gutter may be formed only along the longitudinal sides adjacent the side walls 32 of the shadow box 30. In the illustrated embodiment, the gutter 40 may have a depth of 1 inch from the playing surface 12. In another embodiment, the gutter 40 may be approximately 0.75-3 inches in depth from the playing surface 12. In the illustrated embodiment, the gutter 40 may have a width of 1.75 inches. The width of the gutter 40 may be greater than a diameter of the ball 16 to ensure the ball 16 falls into the gutter 40 and does not easily bounce off the walls 32, 34 of the shadow box 30 and remain on the playing surface 12.

The hole pattern 20 may have a plurality of pockets corresponding to each of the holes 22, 24, 26 that do not extend through the playing surface 12. The balls 16 are retrieved from the pockets after each roll and scored. Alternatively, the hole pattern 20 may have a plurality of through-slots that extend through the playing surface to a ball catch 50. The game table 10 may have a pair of ball catches 50, where one ball catch 50 is disposed below the each of the hole patterns 20.

The ball catch 50 has a plurality of channels 52 the corresponds to each of the holes 22, 24, 26 with dividers to keep balls 16 directed to the specific channel for the hole scored. Each ball catch 50 has a return opening 54. The return opening 54 is disposed outboard of the gutter and allows the players to easily retrieve and keep track of the score of the balls. The channels 52 will vary in length, width and depth depending on the size of the game table 10. Lines and Numbers The game table 10 may have lines applied to the playing surface 12 for aiding in score and playing (four at each end of the table). Two foul lines 42 extending in the width direction and are placed between the midline 46 and the hole pattern 20. The players must release the ball 16 before the foul line 42. In one embodiment, the foul lines 42 are positioned 24 inches from the back edge 38 of the playing surface 12. The score lines and numbers 48 may also be applied to the playing surface 12 to indicate the score of each hole.

The game table 10 may also include a ball holder 60 for storing the balls 16. The ball holder may include a ball rack having pockets for securely holding the balls 16. The pockets in the ball rack may be sized slightly smaller than the balls 16 so the balls fit snug in each pocket holding them securely in place even if rack is tilted at a 45-degree angle.

The playing surface 12 having the V-shaped hole pattern 20 and the gutter 40 may be scaled in size for different applications and different style games. For example, a table top version of the game table 10 may be portable to taking the game table camping, to parks, tailgates, the beach, etc. The mobile game table allows players to place the playing surface 14 on an existing table or surface. The mobile game table may be made by using a single piece of material such as wood, plastic, vinyl, PVC board, metal that forms the playing surface 12, gutters 40 and outside walls 32, 34. The gutters 40 may be routed out into this single piece of material creating the playing surface 12 in the center and walls 32, 34 defining the periphery. Holes for scoring points will remain in a "V" shape hole pattern 20. The holes 22, 24, 26 may be pockets that do not extend through the playing surface 12. The players may retrieve the balls 16 from the pockets after each roll. The mobile game table may have a ball catch with a single channel corresponding to the center end hole 22.

In another embodiment, the playing surface 12 may also be a green turf putting surface to play a golf-style game. The golf game table 10 may have a width dimension of 4-5 feet and a length dimension of 12-15 feet in length.

In another embodiment, a bowling-style game may be played with using the hole pattern 20. The playing surface may have a width dimension of 8-12 feet and a length dimension of 40-50 feet. At the end of each playing surface there will be five holes in a V-pattern that extend through the playing surface. The smallest center hole 22 may measure 8-12 inches in diameter. The intermediate holes 24 may measure 16-20 inches in diameter. The largest outer holes 26 may measure 24-30 inches in diameter. The hole spacing A between the outer hole 26 and the intermediate hole 24 may measure 2.5 feet. The hole spacing B between the intermediate hole 24 and the center end hole 22 may measure 2 feet. The balls used for the bowling style game may be 1.5 lbs-2.5 lbs and 3.5-4.5 inches in diameter. The balls may made of hard plastic, wood, or metal, and can be painted solid or given unique finishes such as marbleized, opaque, pearlescent, or even glow-in-the-dark. The playing surface may be wood with a clear high gloss finish. In another embodiment, the playing surface may be a smooth firm flexible rubber. This can allow the option of 6-12 hydraulic lifts to be placed under the rubber playing surface at symmetrical spots. Each hydraulic lift can raise from 0.5-6 inches changing the flexible rubber playing surface.

The following is a list of reference numerals:

10—Game table
12—playing surface
14—playing ends
16—balls
18—legs
20—hole pattern
22—small center-end hole
24—intermediate holes
26—large outer holes
28—rows of holes
30—shadow box
32—side walls
34—end walls
36—longitudinal edge of playing surface
38—back edge of playing surface
40—gutter
42—foul lines
44—longitudinal centerline
46—midline
48—score lines
50—ball catch
52—ball catch scoring channels
54—ball catch opening
60—ball holder While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A game table comprising:

a horizontal and planar playing surface having opposing playing ends;

a pair of hole patterns formed adjacent each of said opposing playing ends, each hole pattern having a plurality of holes decreasing in diameter toward said opposing playing ends, wherein each hole pattern of said pair of hole patterns is formed in two rows of holes intersecting at an end hole being closest to each of said opposing playing ends to form a V-shaped hole pattern of said pair of hole patterns;

a gutter formed along and surrounding said horizontal and planar playing surface along longitudinal side edges and back edges adjacent said opposing playing ends and configured to catch balls that roll off of said horizontal and planar playing surface along each of said longitudinal side edges and along each of said back edges adjacent said opposing playing ends;

a plurality of balls each smaller than said end hole and said gutter; and smaller than a width of a pair of ball catches, one of said ball catches disposed below one of each of said plurality of holes.

2. The game table of claim 1, wherein said opposing playing ends are spaced apart in a length dimension to allow players to participate from each of said opposing playing ends, said length dimension greater than a width dimension of said horizontal and planar playing surface.

3. The game table of claim 2, wherein said length dimension is a least 2.5 times said width dimension.

4. The game table of claim 2, wherein each of said plurality of holes is spaced apart in said width dimension by a hole-spacing distance, wherein said end hole is spaced apart in said width dimension from intermediate holes by a second hole-spacing distance and said intermediate holes are spaced apart from outer holes by a first hole-spacing distance, wherein said second hole-spacing distance is greater than said first hole-spacing distance.

5. The game table of claim 1, wherein said V-shaped hole patterns are mirror images of each other about a centerline between said opposing playing ends.

6. The game table of claim 1, wherein said plurality of holes comprises a plurality of through-slots that extend through said horizontal and planar playing surface.

7. The game table of claim 1, wherein each hole pattern of said pair of hole patterns comprises five holes.

8. The game table of claim 1, wherein each hole pattern of said pair of hole patterns is symmetric about a longitudinal centerline of said horizontal and planar surface.

9. The game table of claim 1, wherein said end hole has an end-hole diameter being smaller in diameter than other holes of said plurality of holes.

10. The game table of claim 1, wherein each of said ball catches is connected to a plurality of channels, wherein each channel of said plurality of channels is connected to one of said plurality of holes.

11. A game table comprising:

a horizontal and planar playing surface having opposing playing ends spaced apart in a length direction having a length dimension to allow players to participate from each of said opposing playing ends, said length dimension greater than a width dimension of said horizontal and planar playing surface;

a pair of V-shaped hole patterns oriented in said length direction, each of said V-shaped hole patterns formed adjacent one of said opposing playing ends, each of said V-shaped hole patterns having a plurality of holes extending through said horizontal and planar playing surface, said plurality of holes decreasing in diameter toward a center-end hole positioned closest to said opposing playing ends wherein each said V-shaped hole patterns are symmetric about a longitudinal centerline in said length direction of said horizontal and planar playing surface;

at least one ball sized smaller than said center-end hole of said plurality of holes;

a gutter formed along and surrounding said horizontal and planar playing surface along longitudinal side edges and back edges adjacent said opposing playing ends; and configured to catch balls that roll off of said horizontal and planar playing surface along each of said longitudinal side edges and along each of said back edges adjacent said opposing playing ends; and a pair of ball catches, each ball catch of said pair of ball catches disposed below each of said plurality of holes.

12. The game table of claim 11, wherein each of said plurality of holes are spaced apart in a width direction by a hole-spacing distance less than a ball-diameter size.

13. A game table comprising:

a horizontal and planar playing surface having opposing playing ends;

a pair of hole patterns formed adjacent each of said opposing playing ends, each of said pair of hole patterns having a plurality of holes formed in two rows of said plurality of holes intersecting at an end hole, said end hole being closest to said opposing playing ends to form a V-shaped hole pattern, said plurality of holes decreasing in diameter toward said opposing playing ends, wherein said end hole has an end-hole diameter that is smaller than other holes of said plurality of holes; and a gutter formed along and surrounding said horizontal and planar playing surface along longitudinal side edges and back edges adjacent said opposing playing ends and configured to catch balls that roll off of said horizontal and planar playing surface along each of said longitudinal side edges and along each of said back edges adjacent said opposing playing ends; and at least one ball sized smaller that said end hole of said plurality of holes.

14. The game table of claim 13, wherein each of said plurality of holes is spaced apart in a width direction by a hole-spacing distance and said opposing playing ends are spaced apart in a length direction, wherein said end hole is spaced apart in said width direction from intermediate holes by a second hole-spacing distance and said intermediate holes are spaced apart from outer holes by a first hole-spacing distance, wherein said second hole-spacing distance is greater than said first hole-spacing distance.

* * * * *